United States Patent [19]

Sanfilippo

[11] 4,349,128

[45] Sep. 14, 1982

[54] MOVABLY MOUNTED DISPENSER FOR BULK MATERIAL

[76] Inventor: Jasper B. Sanfilippo, Plum Tree Rd., Barrington Hills, Ill. 60010

[21] Appl. No.: 157,792

[22] Filed: Jun. 9, 1980

[51] Int. Cl.[3] ..... B67D 5/64

[52] U.S. Cl. ..... 222/166; 222/547; 222/559; 222/129

[58] Field of Search ..... 211/49 D; 221/130; 222/129, 160, 164, 166, 511, 547, 559, 143

[56] References Cited

U.S. PATENT DOCUMENTS

| | | | |
|---|---|---|---|
| 878,443 | 10/1907 | Young | 222/561 |
| 969,916 | 9/1910 | Stehlik et al. | |
| 1,276,382 | 8/1918 | Loveland . | |
| 1,909,670 | 5/1933 | Evans . | |
| 2,181,661 | 11/1939 | Lowry . | |
| 2,996,218 | 8/1961 | Lux . | |
| 3,396,869 | 8/1968 | Gale . | |
| 3,744,677 | 7/1973 | Beall . | |

*Primary Examiner*—H. Grant Skaggs

*Attorney, Agent, or Firm*—Fitch, Even, Tabin, Flannery & Welsh

[57] ABSTRACT

A movably mounted supply dispenser for bulk material is provided that has apparatus for mounting a container having inlet and outlet ends on a rack having spaced vertical supports. The mounting apparatus provides translation of a given generally horizontally directed thrust applied against the outlet end of the container into an angular motion of said container having upward components and horizontal components at both the inlet and outlet ends. The upward motion of the inlet end is greater than the upward motion of the outlet end for the given applied horizontal thrust. A system of such containers may also be provided in a freestanding rack allowing for the dispensing of many different bulk products.

7 Claims, 4 Drawing Figures

Fig. 1.
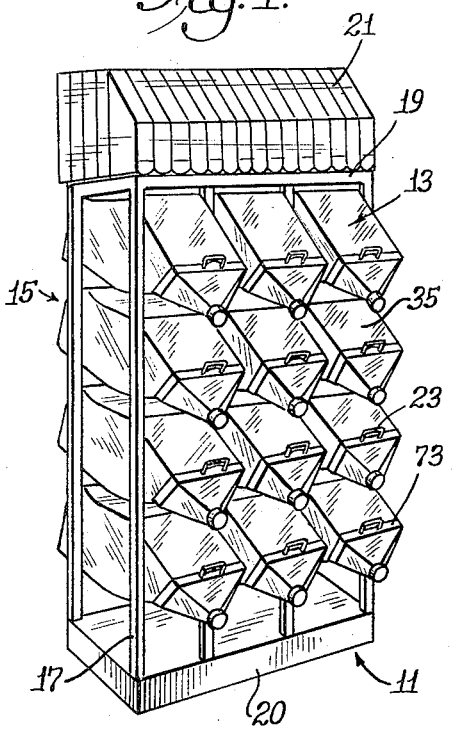
Fig. 2.
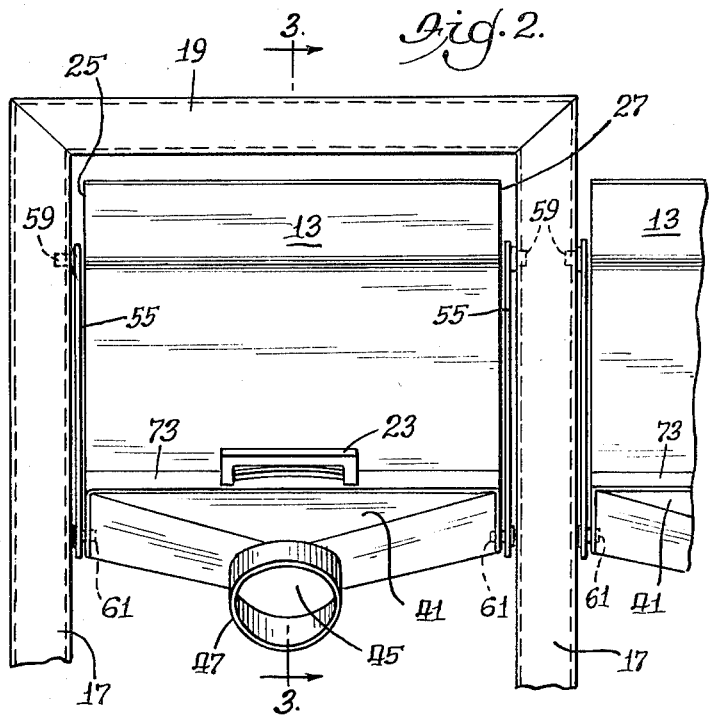
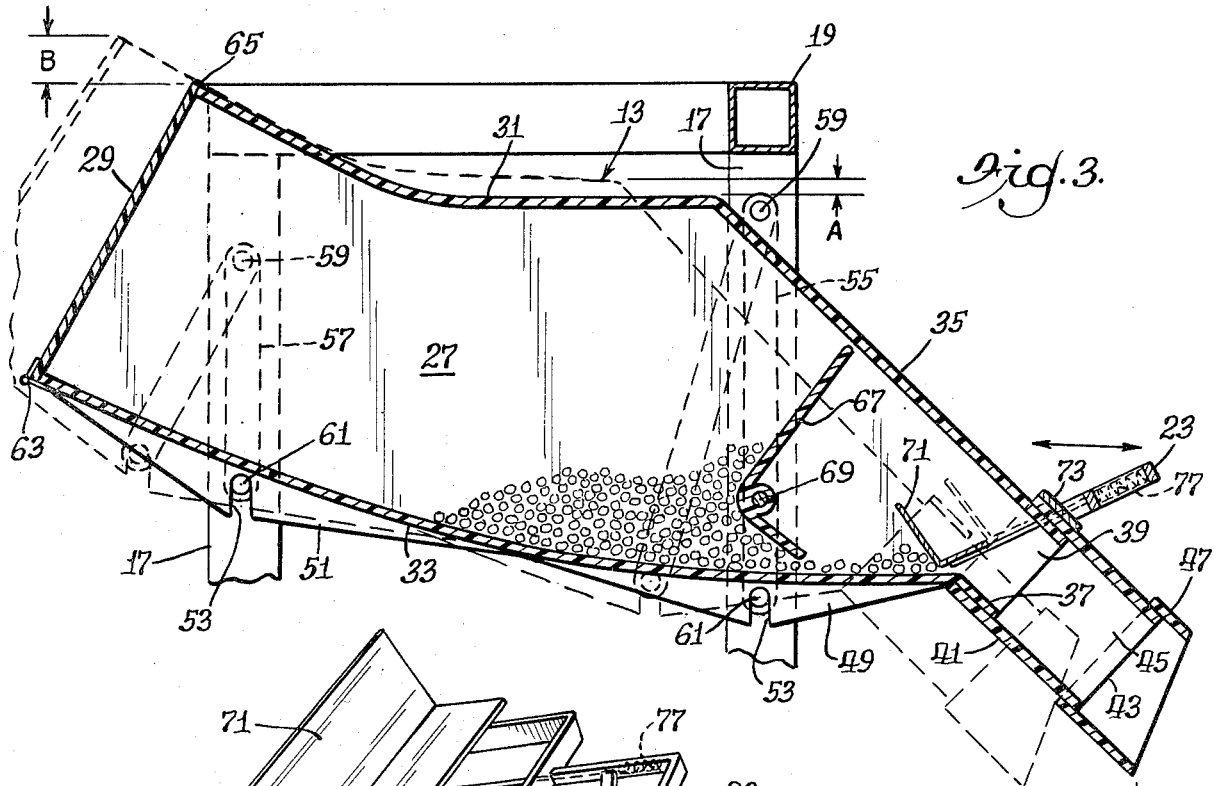
Fig. 3.
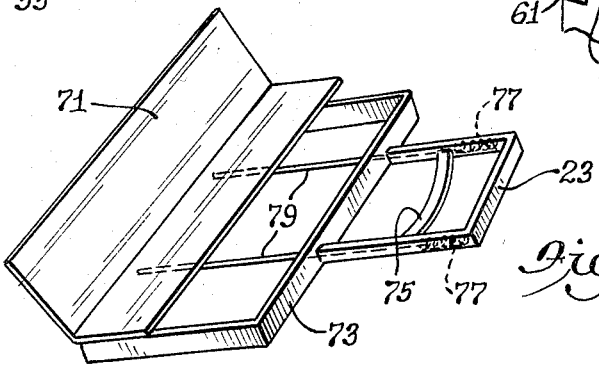
Fig. 4.

MOVABLY MOUNTED DISPENSER FOR BULK MATERIAL

This invention relates to supply containers for dispensing bulk materials and more particularly to supply containers movably mounted to assist in discharge of the contents.

Containers movably mounted on support racks and frames are widely used in handling bulk materials in supply yards and on construction projects. Such containers are customarily sized to handle several yards of loose material, such as sand, gravel, rock, concrete mix, coal, grain and the like. Other dispensing containers are utilized for bulk products, such as tacks, small nuts, bolts and the like for use in various industries. Still others are utilized for dispensing bulk food products in, for example, retail grocery and food service stores where it is desirable to have the bulk material or product accessible to the consumer while at the same time maintaining sanitary conditions.

The principles of this invention may be utilized in any of the foregoing dispensing operations, but it has particular advantageous application to the dispensing of bulk food material, which may be any bulk food in the unpackaged state. A few examples of such bulk food are nuts, sunflower and squash seeds, health snack fruit mixes, beans, granola, banana chips, dried fruit, and candies. A conventional bulk food container has a lid removable from a wide neck through which a scoop is inserted by hand to remove an amount of the product. The scoop is often overfilled and excess product falls from it as it is removed from the container for depositing the product in a sack or other holder. Furthermore, the very act of inserting an outside object, such as the scoop, and a person's hand within the container exposes the contents to contamination. There is also potential exposure to contamination from sneezing and coughing in the vicinity of the open container.

In use of this conventional container there may still be some of the product left in the bottom when the supply of the container is replenished. Such product remains there on the bottom and after several times of replenishment, this bottom material is no longer fresh, giving cause for customer complaint if at some later time that bottom product is purchased.

Accordingly, it is an object of this invention to provide a dispenser for bulk material constructed to minimize loss of product during the act of product dispensing.

It is a further object of this invention to provide a dispenser for bulk material constructed so as to dispense the product without exposing the product to the open atmosphere and thus to avoid direct exposure to contamination.

It is yet another object of this invention to provide a dispenser for bulk material which has provision for rotation of product upon replenishing the supply of product in the container.

Other objects and advantages will become apparent upon reading the following detailed description in conjunction with the attached drawings in which:

FIG. 1 is a perspective view of a system of movably mounted dispensers for bulk materials constructed in accordance with the principles of this invention;

FIG. 2 is a partial front view of the system of FIG. 1 illustrating a dispenser and its mounting;

FIG. 3 is a side sectional view of the dispenser and its mounting taken along the line 3—3 of FIG. 2 in the direction of the arrows; and FIG. 4 is a perspective view of flow control member enlarged for clarity of illustration.

Briefly, there is provided in accordance with this invention a container for dispensing bulk material that is movably mounted on a rack. There is a single discharge passage provided in the container for the bulk material contents, and the container is movable longitudinally to a somewhat inclined position which assists movement of the bulk material within the container toward the discharge passage.

The container is mounted on a rack or framework which is freestanding and includes a plurality of vertical members on which a plurality of such containers are mounted. Means are provided for mounting the containers to the upright members in a manner that allows the containers to be moved longitudinally. For example, a force or thrust may be applied to the front of the container in a generally horizontal direction toward the rear to move the container in that direction. The mounting means, however, translates the rearward thrust into a rocking or angular movement of the container creating more of a rise in the rear end of the container than in the front end of the container when the rearward thrust is applied to the front of the container. The discharge passage is at the front of the container, and so when the rear end rises more than the front end, the bottom is inclined, and the bulk material flows down the inclination toward the front end into the discharge passage.

The container also can be rocked to-and-fro to agitate the product and move it toward the front when the supply is otherwise low. Preferably, the container is constructed with a funnel-like form at its discharge end that leads to the discharge opening confluence leading to the discharge passage at the front. An access door is provided at the rear for adding new product to replenish the supply. In the illustrated embodiment, each container is cradled in such a manner that the individual containers are replaceable for cleaning or for easy replacement when broken or damaged. A manually adjustable gate controls the flow of the product to the discharge opening.

More specifically and with reference to FIG. 1, there is shown a system 11 of dispensers for bulk material including a plurality of containers 13 constructed and mounted for movement in accordance with the principles of this invention. The containers are all supported on a freestanding rack 15 which includes a plurality of upright or vertical members 17. Transverse members 19 are joined to the upright members 17 and are so interconnected as to form a unitized framework, all of which is supported by a base 20. The various members of the rack 15 may be made of any suitable material, such as tubular steel having a square cross section. The transverse members may be joined to the vertical members in any suitable manner, such as by welding or by bolting or other suitable fastening means.

Although the principles of this invention may find application in containers for dispensing most any kind of bulk material, they are particularly applicable and advantageous for use in dispensers for bulk food in the unpackaged state, such as nuts, seeds, health snack fruit mixes, beans, granola, banana chips, and raisins. Such dispensing may be in a retail food store where it is desirable to attractively display and even highlight the bulk food products. Accordingly, an attractive canopy attached to the rack 15 by a suitable frame (not shown) is provided for installation of the canopy overhead of the system of containers. Suitable decorative design and other indicia may be provided on the canopy to attract attention and otherwise advertise the products.

The purpose of the freestanding rack 15 is to provide support for a plurality of the containers 13. It is contemplated that a flowable bulk food product will be carried by each container for the purpose of dispensing at a retail food convenience center. This kind of bulk food dispensing permits the purchaser to obtain as much of the product as desired and pay for it by weight, which is more convenient for some purchasers who may not want to be bound by the fixed weights of prepackaged products. Of course, bulk food dispensing is not new. Large-mouth containers with covers wherein the product is removed by use of a hand scoop have long been in use. The probability of contamination, however, is ever present. Moreover, there is also the likelihood that when the supply is replenished in the container, the fresh product is poured in on top of the old, leaving the older product to continue its aging process in the bottom of the container.

In accordance with this invention, the container 13 is provided with movable mount means so that agitation can be applied to the container by back-and-forth manual movement of the container itself without the purchaser having direct access to the food product within the container. Furthermore, a special movement is applied to the container which enhances the flow of material within the container toward the outlet end as will be described hereinafter. The form of the outlet also is restrictive as far as purchaser access to the contents of the container is concerned.

As will be seen in FIG. 3, a generally horizontal, to-and-fro motion may be applied to the container 13 in the direction of the arrows as indicated by a person gripping a handle 23 at the front or outlet end of the container 13. It is a feature of this invention that the container 13 is mounted in such a manner as to translate a horizontal rearwardly directed thrust applied against the front end of the container into an angular motion of the container such that both the rear and the front ends have upward components of motion as well as horizontal, but the rear end has a greater upward motion than does the front end. Stated otherwise, there is also a rocking motion of the container 13 about a transverse axis that occurs simultaneously with a rearward horizontal thrust applied against the front end of the container which results in the bottom inclining forwardly at the backside of the rear thrust to enhance the movement of the contents in the container toward the outlet. A to-and-fro rocking movement, on the other hand, can be utilized to agitate the contents of the container.

It will be noted that the container 13 of the illustrated embodiment is in a form that differs considerably from a totally right-sided enclosure in which the various faces are flat and intersect one another at right angles. In this illustrated embodiment, the container 13 includes flat left and right sides 25 and 27 respectively (as viewed from the front in FIG. 2), a flat rear end 29 (FIG. 3), an angled top 31 (FIG. 3), a gently curving and generally sloping bottom 33 (FIG. 3), and a flat inclined front 35. The inclined front and the curved bottom along with the two sides terminate at the lower front corner in a collar 37 which defines an opening or outlet 39. The opening 39 is generally rectangular in shape. The collar 37 serves as a support for an over-fitting spout 41, which as may be seen in FIGS. 1 and 2 has the form of a flattened funnel, the sides of which convene in an annular edge 43 that defines a circular opening 45. Mounted over the periphery of the edge 43 is an outlet guide ring 47. This outlet guide ring serves to direct the outflow of the contents of the container 13 into a sack or other receptacle held by a purchaser. The guide ring 47 is shown in the form of a cylinder truncated by an inclined plane. The guide ring could also be a reducing type ring, i.e., in the form of a cone truncated by an inclined plane whereby the outlet end of the ring is smaller than the inlet end of the ring.

It already has been mentioned that the sides 25 and 27 are flat. In general, the sides are formed so as to butt against the edges of the intersecting faces, such as the top front and back. In the instance of the bottom 33, however, it will be noted in FIG. 3 that the sides in some portions extend below the bottom 33. These portions that extend below the bottom 33 are in the form of mounting projections 49 toward the front and 51 toward the rear as viewed in FIG. 3. Each of these mounting projections has a U-slot 53 formed therein opening outwardly in the outer edge of the projections 49 and 51.

It should be understood that although only side 27 is shown in FIG. 3, the side 25 and its associated mounting details are merely mirror images of that which is shown in FIG. 3. Also shown in FIG. 3 in dashed lines is an alternative rearward position of the container 13 which has been achieved by a rearwardly directed force against the front end of the container at the handle 23. Thus, in accordance with this invention, for a movement of the container 13 in the rearward direction by a given distance R, the top 31 at the front end experiences a vertical rise A while the top at the rear end experiences a vertical rise B that is greater than A. Stated otherwise, in accordance with this invention each container 31 is movably mounted such that a rearwardly directed thrust applied generally horizontally at the front end of the container 13 will be translated into angular motions having certain horizontal and certain vertical components in the upward direction near both the front and rear ends of the container, the components of motion near the rear being less horizontally and greater upwardly than the corresponding components near the front for the given rearward thrust.

One important advantage that accrues to dispensers utilizing this invention is the controlled pouring or discharge of the contents from the container by the purchaser. It may well be proposed that a container could be rotatably mounted about a single axis whereby the purchaser would rotate or tilt the container to an angle sufficient to pour out or discharge the contents. Such a motion, of course, is dependent upon the proper attention given the action by the purchaser. Any carelessness could result in an overpouring and thus a spilling and consequent wastage of the contents. On the other hand, too rapid of a discharge could also result in an overfilling of the sack or other receptacle used by the purchaser, who then might want to return the excess contents to the container. Such return, of course, would expose the contents to contamination.

The tilting or rocking motion of the container 13 translated from a rearward horizontal force applied by the purchaser to the front is created by mounting means intermediate the container 13 and the uprights 17. In the illustrated embodiment, the mounting means includes a first pair of carriage links 55 disposed near the front end of the container 13 and by a second pair of carriage links 57 disposed near the rear end of the container 13. A stud 59 is provided at one end of the carriage links 55 and 57 and an oppositely directed stud 61 is provided at the other end. The studs 59 are received by appropriate clearance holes (not indicated) in the uprights 17, and the oppositely directed studs 61 at the other end of the links are received in the U-slots 53 in the mounting projections 49 and 51 adjacent the respective links. Thus, the container 13 is suspended for rocking motion between the uprights 17 in the freestanding frame 15. When the container is at rest, these links are all parallel. The carriage links 57, however, are of shorter length than the carriage links 55. Movement occurs about the axes of the studs 59 and about the axes of the studs 61. Since the axes of the studs 61 move with the container 13, the fixed axes are those of the studs 59 in the uprights 17 of the framework. The studs 61 move through arcs whose radii correspond to the lengths of the links 55 and 57 respectively. Accordingly, the front and rear ends of the container both swing through arcs, but of different radii. The rear end links have the shorter radius, and, hence, the smaller arcs. The smaller arcs in the rear causes the rear end of the container to have a greater upward component of motion than the front end for a given rearwardly directed longitudinal thrust of the container.

The bottom 33 slopes toward the outlet end even when the container is at rest. The differential in upward movement between the front and rear ends, however, further inclines the bottom 33 toward the front or outlet end of the container 13 when a rearwardly directed thrust is applied. Thus, movement of the contents toward the outlet end is enhanced, yet controlled. It can be seen that the structure creating the movement resulting in this differential in upper movement to further include the bottom exercises control over the change in degree of inclination and thus avoids sudden avalanches of the bulk contents that might cause spillage and waste. Although this desirable motion of the container 13 is accomplished by the structure illustrated, the front and rear portions of the container moving through arcs of different radii upon a rearward thrust could also be accomplished through other structural means. For example, cam and cam follower combinations could be provided beween the uprights 17 and the container 13 to accomplish this principle of translational movement. The cam follower could be formed in the arc desired for a particular portion of the container to follow upon the application of a rearward thrust. The structure illustrated in the embodiment of FIG. 3 is provided for purposes of describing the principle, and it is not intended that the invention be limited to the particular structure illustrated.

The illustrated means intermediate the container 13 and the uprights 17 suspending the container in the manner shown also provides the advantage of allowing the container to be freely removable for cleaning or repair and then replaced or even exchanged with another container. Although the illustration in FIG. 3 shows one container 13, it should be understood that the description and drawing in respect of the one unit applies as well to the plurality of containers in the system of dispensers 11 illustrated in FIG. 1.

The flat rear end 29 is in the form of a door hingedly connected to the rear end of the bottom 33 by a hinge 63 and is held in a closed position by suitable means, such as a snap action fastener 65 at the top. Thus, the rear end is an inlet for replenishing the product in the illustrated container.

The front end already has been referred to as the outlet end. This physical arrangement advantageously provides for the desirable rotation of the bulk material on a first-in-first-out basis. The fresh material being added from the rear on the sloping bottom 33 tends to push the older material toward the front where it will be in position to be discharged ahead of the freshly added material.

As mentioned previously, the degree of change of inclination of the bottom 33 upon a rearward thrust of the container 13 is controlled by the structural mechanism rather than the whim of the purchaser. The speed of change, however, is under the control of the purchaser. Hence, there are two further members provided to assist in the control of the product at discharge. In FIG. 3, there is shown a baffle 67 having an L-shaped cross section. The baffle extends the complete width of the container on the inside and is retained in position by a rod 69 that is journalled in suitable bushings (not shown) in the sides of the container for pivotal mounting and retention. The rod 69 mounts the baffle by being received in a cylindrical hub integrally associated with the baffle 67. The baffle is disposed in the narrowing portion of the container formed between the inclined front 35 and the front portion of the bottom 33. The baffle does not, however, entirely close off the passage. In the disposition of the baffle shown in FIG. 3, there is a gap between the end of the shorter leg and the bottom 33. The pivotal mounting of the baffle allows the baffle to be turned about the rod 69 as a pivot. It is illustrated as being turned as far in the clockwise direction as structure will permit, however. It will be noted that the upper end is in contact with the inclined front 35, blocking further clockwise turning. Thus, although a gap between the lower end of the baffle and the bottom 33 is at a minimum, it is not completely closed. On the other hand, the gap can be increased by turning the baffle 67 in a counterclockwise direction to accommodate products of varying texture. Such is desirable if the product consists of coarse separate particles, such as large nuts. On the other hand, a smaller gap is desirable for a fine textured, more flowable material. The baffle fits rather snugly in position so that it requires a deliberate effort to turn it. It is not intended that the purchaser adjust the rotative position of this baffle, and it will be noted that there is no direct access to the baffle from the purchaser's end, i.e., the outlet end. The attendant replenishing the supply of the product, however, can reach in from the rear and adjust the baffle as necessary for the particular product.

The other member that assists in controlling discharge is a gate 71. The gate 71 is an angular member that also extends across the entire inside width of the container 13. A better view of the gate and its operation is seen in FIG. 4. The gate 71 is controlled at the handle 23. The handle 23 is attached by suitable means, such as by welding, to a frame 73. This frame forms a band around the joint between the collar 37 and the spout 41. The frame may be of flat metal strips forming a U-shaped member which attaches over three sides of the joint, or it may be made of four members, in which instance a total band is formed around the joint. The frame is fastened to the spout by suitable means to ensure its firm position. The handle 23 may be in the form of a channel with the webs facing inwardly. A movable member 75 rides in the channel and moves against biasing members, such as a pair of springs 77. Each end of the movable member 75 is attached to a support rod 79 that extends through the frame 73 and is connected to one side of the angular gate 71 as indicated in FIG. 4. As may be seen in FIG. 3, the handle 23 is set at such an angle with respect to the frame 73 so as to carry the gate 71 inwardly to a point where the apex of the gate 71 in rest position just closes against the bottom 33. Thus, in the rest position, the gate is closed and the material flowing in the gap between the baffle 67 and the bottom 33 is blocked from any further progress toward the outlet. A hand squeeze between the handle 23 and the movable member 73 against the springs 77 will open the gate to a position indicated by the dashed lines in FIG. 3. The product is then free to flow beyond the gate into the spout 41 and out the outlet guide ring 47. To stop the flow, the handle is released, and the springs return the gate 71 to its closed position.

For the purpose of dispensing food, it is desirable for the container 13 to be made of transparent material so that the purchaser can see the contents. One satisfactory material that has been used in connection with the illustrated embodiment is a clear product of synthetic resin materials sold under the trademark Plexiglas. On the other hand, the spout 41 may be made of an opaque material, such as a suitable formed plastic. The base 20 may be formed of a suitable material, and the uprights 17 and cross members 19 may be made of a suitable tubular material, such as tubular steel, square in cross section.

The principles of this invention are not limited to bins or containers of particular physical sizes. For purposes of an example, the following system of dispensers has been constructed. The base 20 is $3\frac{1}{2}$ feet long by $1\frac{1}{2}$ feet deep. The uprights 19 are approximately $4\frac{1}{2}$ feet high. Each space separating the uprights 19 across the front in which the containers 13 are mounted is approximately 1 foot. Each container without the spout 41 is approximately 30 inches from the rearmost point, or hinge 63, to the frontmost point, or lower edge of the inclined front 35. The container width is 11 inches, and the general internal height (vertically) is approximately 10 inches in the rear and approximately 11 inches at the highest point near the front. The annular opening of the ring 47 is approximately 3 inches in diameter. The back panel 29 is inclined approximately 30° with respect to the vertical. The stud center to stud center of the front carriage links 55 is $10\frac{1}{2}$ inches and the stud center to stud center of the rear links 57 is $5\frac{1}{2}$ inches. In addition, the rear links are pivoted on the uprights at points lower than the front links 55. When each container is in the rest position, the bottom surface 33 is sloped downwardly toward the front or outlet end. A hand controlled gate 71 in accordance with that described herein is used to control the discharge of the contents of the container. The system includes 12 containers on the rack.

In operation, a plurality of containers 13 are suspended in position between the uprights 17 by the pivotal members or links 55 and 57. The hinged door 29 at the rear of each container is opened, and each container is filled with a supply of a bulk food product. Because the bulk food products may range in texture from a fine, flowable material to a coarse, separate particle material, the attendant filling the containers adjusts the baffles 67 of each container according to the product in that container. The baffle is turned completely clockwise (as viewed in FIG. 3) to effect a minimum gap or passage for a fine textured material and progressively counterclockwise to increase the gap to accommodate a coarser product. The rear doors 29 are then closed and retained in the closed position by the snap action fasteners 65.

Each container being of transparent material displays its contents for purchaser selection. A supply of sacks or other suitable receptacles is made available to the purchaser who then holds one beneath or in surrounding relation to the outlet guide ring 47 of the selected container with one hand. The handle 23 is grasped with the purchaser's other hand. The next step depends mostly on the altitude of the contents. If it is piled up behind the baffle 67 and available to flow through the gap when the gate 71 is opened, then a gentle rearward thrust by the purchaser while simultaneously squeezing against the movable member 75 to open the gate 71 is all that is needed to start a discharge flow of the contents. The container is held in the rearward position (which increases the forward inclination of the bottom 33 and the contents) until the desired amount of contents is discharged, at which time the movable member 75 is released and the gate 71 is closed by the springs 77 to stop the discharge. Otherwise, the purchaser can first agitate the contents by a few quick to-and-fro movements of the container before holding the container at the approximate limit of a rearward thrust and opening the gate.

Although the purchaser has control over the discharge of the product, there is no direct access to the product in the container by the purchaser.

As an alternative to the illustrated embodiment where it is desired to provide containers of the foregoing type for products that will not convey easily by limited tilting, e.g., dried apricots, a container may be provided as already shown and described but without the baffle 67 and the gate 71. The handle 23 and all other structure is the same for uniform appearance. A form of a rake (not shown) is then provided that has a stainless steel rod with a knob for a handle at one end and suitable tines at the other end. The stainless steel rod extends through a clearance hole provided for the purpose in the sloping front 35, whereby the purchaser, still without direct access to the contents, can maneuver into the spout and out through the ring 47 into a waiting receptacle. In such instance, there is no need to move the container 13, and at least one of the links might desirably be strapped or otherwise secured to an upright to secure the position of the container. The only movement in this condition is the action of the rake.

Thus, there has been provided in accordance with this invention a movably mounted dispenser for bulk material which includes a container having inlet and outlet ends, a rack having spaced vertical supports mounting the container, and means intermediate the container and the vertical supports movably mounting the container on the vertical supports and providing translation of a given generally horizontally directed thrust applied against the outlet end of the container into an angular motion of the container having upward components and horizontal components at both the inlet and outlet ends, the upward motion of the inlet end being greater than the upward motion of the outlet end for the given applied horizontal thrust.

It will be seen from the foregoing description that this form of movably mounted container provides several advantages in devices for dispensing bulk material. The dispenser restricts direct access to the product by a purchaser of the product to reduce exposure to contamination and the contents are not otherwise exposed to the public in general. The flow of bulk material from the container during discharge is controlled to minimize waste. There is a positive gate closure to minimize leakage, and there is natural rotation of the product because of the manner in which the supply within the container is replenished. The containers are made of transparent material, which permits the bulk food product to be displayed; the appearance of the container is unusual and attracts attention; and a plurality of such containers may be attractively displayed as a center of attention.

While the invention has been described in connection with a preferred embodiment, alternatives, modifications, and variations may be apparent to those skilled in the art in view of the foregoing description. Accordingly, it is intended to embrace all such alternatives, modifications, and variations as fall within the spirit and scope of the appended claims.

What is claimed is:

1. A movably mounted dispenser for bulk material, comprising:

a container having inlet and outlet ends; a rack having spaced vertical supports; and means intermediate said container and said vertical supports movably mounting said container on said vertical supports and providing translation of a given generally horizontally directed thrust applied against the outlet end of said container into an angular motion of said container having upward components and horizontal components at both the inlet and outlet ends, the upward component of the inlet end being greater than the upward component of the outlet end for the horizontal distance moved by the container, said intermediate mounting means including two pairs of elongated members pivotally mounted at one of their ends to said spaced vertical supports and at the other of their ends to opposing sides of said container adjacent the respective members, all members being parallel when said container is at rest, one pair of said elongated members being located adjacent the outlet end of said container and the other of said pairs being located adjacent the inlet end of said container, the pair of said elongated members at the inlet end being shorter than the pair at the outlet end.

2. A dispenser in accordance with claim 1 further comprising a manually adjustable gate inwardly adjacent said outflow end controlling outward flow of bulk material from said container.

3. A dispenser in accordance with claim 2 further comprising baffle means inwardly adjacent said gate and generally intermediate said gate and bulk material in said container as an adjunct in controlling the outflow of material from said container.

4. A dispenser in accordance with claim 3 wherein said baffle means is movably adjustable to accommodate bulk materials which from time to time may differ in texture.

5. A dispenser in accordance with claim 2 further including a discharge spout attached to the outlet end outwardly adjacent said gate forming a confluence for the bulk material flowing beyond the gate during discharge.

6. A dispenser in accordance with claim 1 further comprising a hinged axis door disposed in the inlet end of said container opposite said outlet end for replenishing the supply of bulk material providing a physical arrangement whereby older material remains intermediate the fresh material and the outlet creating a rotation of the material such that the older material is dispensed before fresh material.

7. A movably mounted dispenser for a bulk product, comprising:

a container having front and rear ends;

a rack having spaced vertical supports mounting said container;

an outlet opening adjacent the lower edge of the front end of said container;

a spout adjacent said outlet formed by lower portions of said container creating a narrowing of the container adjacent the opening; and two pairs of elongated members pivotally mounted at one of their ends to said spaced vertical supports and at the other of their ends to opposing sides of said container adjacent the respective members, all members being parallel when said container is at rest, one pair of said elongated members being located adjacent the front end of said container and the other of said pairs being located adjacent the rear end of said container, the pair of said elongated members at the rear end of said container being shorter than the pair at the front end.

* * * * *